US009259050B2

(12) United States Patent
Smith et al.

(10) Patent No.: US 9,259,050 B2
(45) Date of Patent: Feb. 16, 2016

(54) FOOTWEAR WITH ORTHOTIC MIDSOLE

(71) Applicant: Superfeet Worldwide, Inc., Ferndale, WA (US)

(72) Inventors: Christopher E. Smith, Custer, WA (US); Jeff Gray, Ferndale, WA (US); Edward Collins, II, Bellingham, WA (US); Peter Daley, Steamboat Springs, CO (US)

(73) Assignee: Superfeet Worldwide, Inc., Ferndale, WA (US)

( * ) Notice: Subject to any disclaimer, the term of this patent is extended or adjusted under 35 U.S.C. 154(b) by 318 days.

(21) Appl. No.: 13/685,236

(22) Filed: Nov. 26, 2012

(65) Prior Publication Data

US 2013/0125419 A1 May 23, 2013

Related U.S. Application Data

(63) Continuation of application No. 13/335,699, filed on Dec. 22, 2011, now Pat. No. 8,341,856.

(60) Provisional application No. 61/427,580, filed on Dec. 28, 2010.

(51) Int. Cl.
*A43B 7/14* (2006.01)
*A43B 7/00* (2006.01)
(Continued)

(52) U.S. Cl.
CPC ..... *A43B 7/00* (2013.01); *A43B 1/0081* (2013.01); *A43B 7/14* (2013.01); *A43B 7/141* (2013.01);
(Continued)

(58) Field of Classification Search
CPC ..... A43B 7/14; A43B 13/00; A43B 13/12
USPC ..... 36/88, 25 R, 30 R, 31, 140, 142–144, 36/150–160
See application file for complete search history.

(56) References Cited

U.S. PATENT DOCUMENTS 2,183,197 A * 12/1939 Kohlruss ..... 36/157
2,235,821 A * 3/1941 Anderson ..... 36/157
(Continued)

FOREIGN PATENT DOCUMENTS

CA 2478749 A1 2/2006
WO 2010/062539 A2 2/2013

OTHER PUBLICATIONS

ARCHY™ Repellent, on sale at least as early as Jun. 2010, retrieved Sep. 14, 2011, from http://www.moszkito.com/womens_sandals/w_repellent.htm, 1 page.
(Continued)

*Primary Examiner* — Marie Bays
(74) *Attorney, Agent, or Firm* — Lowe Graham Jones PLLC; Darren J. Jones

(57) ABSTRACT

Footwear is provided having a midsole platform, a full length insole and a orthotic midsole in the form of an orthotic shell received between the midsole platform and the insole. The orthotic shell has a heel portion to support a heel of a foot of a wearer and a forefoot portion to support a forefoot of the wearer at least in a region behind and near metatarsal heads of the foot. The orthotic shell is shaped to partially cup the heel and support the forefoot in one of a plurality of determined orientations. The footwear may further include a plurality of support plugs to support the orthotic shell in one of the determined orientations and a shank coupled to the midsole platform to increase torsional rigidity of the footwear with respect to a longitudinal length thereof. Methods of making footwear are also provided.

30 Claims, 17 Drawing Sheets

(51) Int. Cl.

| | |
|---|---|
| ***A43B 13/12*** | (2006.01) |
| ***A43B 1/00*** | (2006.01) |
| ***A43B 13/18*** | (2006.01) |
| ***A43B 13/36*** | (2006.01) |

(52) U.S. Cl.

CPC ..... *A43B 7/142* (2013.01); *A43B 7/144* (2013.01); *A43B 7/145* (2013.01); *A43B 7/148* (2013.01); *A43B 7/1445* (2013.01); *A43B 13/12* (2013.01); *A43B 13/127* (2013.01); *A43B 13/188* (2013.01); *A43B 13/36* (2013.01)

(56) References Cited

U.S. PATENT DOCUMENTS

| | | | | |
|---|---|---|---|---|
| 2,288,665 | A * | 7/1942 | Anderson | 36/157 |
| 2,352,170 | A * | 6/1944 | Anderson | 36/157 |
| 4,364,188 | A * | 12/1982 | Turner et al. | 36/31 |
| 4,616,431 | A * | 10/1986 | Dassler | 36/28 |
| 5,345,701 | A * | 9/1994 | Smith | 36/144 |
| 6,199,303 | B1 * | 3/2001 | Luthi et al. | 36/31 |
| 6,487,796 | B1 | 12/2002 | Avar et al. | |
| 6,490,814 | B2 | 12/2002 | Matis | |
| 6,502,330 | B1 * | 1/2003 | David et al. | 36/88 |
| 6,976,322 | B1 | 12/2005 | Walker | |
| 7,694,437 | B2 | 4/2010 | Hogan | |
| 8,341,856 | B2 * | 1/2013 | Smith et al. | 36/25 R |
| 8,984,775 | B2 * | 3/2015 | Dombrow et al. | 36/102 |
| 2004/0111920 | A1 * | 6/2004 | Cretinon | 36/30 R |
| 2005/0160626 | A1 | 7/2005 | Townsend | |
| 2005/0268490 | A1 * | 12/2005 | Foxen | 36/28 |
| 2007/0277401 | A1 * | 12/2007 | Young-Chul | 36/30 R |
| 2008/0196272 | A1 * | 8/2008 | Hay et al. | 36/88 |
| 2008/0263894 | A1 | 10/2008 | Nakano | |
| 2009/0031584 | A1 | 2/2009 | Rasmussen et al. | |
| 2011/0099845 | A1 * | 5/2011 | Miller | 36/91 |
| 2011/0252671 | A1 | 10/2011 | Maron et al. | |
| 2012/0017467 | A1 | 1/2012 | Whitney et al. | |

OTHER PUBLICATIONS

ARCHY™ Wing, on sale at least as early as Jun. 2010, retrieved Sep. 14, 2011, from http://www.moszkito.com/womens_sandals/w_wing.html, 1 page.

Freewaters Company Q&A, dated Aug. 1, 2010, retrieved Sep. 14, 2011, from http://www.malakye.com/asp/front/CMSPage.asp?TYP_ID=2&ID=3169, 7 pages.

Montrail, "Men's Molokai," on sale at least as early as Dec. 2010, retrieved Sep. 14, 2011, from http://www.montrail.com/Men%27s-Molokai%E2%84%A2/GM1121,default,pd.html, 2 pages.

Orthaheel, "Wave Thong," on sale at least as early as Jun. 2010, retrieved Sep. 14, 2011, from http://www.orthaheel.us/Orthaheel_Wave.html, 1 page.

* cited by examiner

FOOTWEAR WITH ORTHOTIC MIDSOLE

CROSS-REFERENCE TO RELATED APPLICATIONS

This application is a continuation application of U.S. application Ser. No. 13/335,699, filed Dec. 22, 2011, which claims the benefit under 35 U.S.C. §119(e) of U.S. Provisional Patent Application No. 61/427,580, filed Dec. 28, 2010, the entire disclosures of which are herein incorporated by reference for all purposes.

BACKGROUND

1. Technical Field

This disclosure generally relates to footwear and orthotic devices, and more particularly to footwear and orthotic midsoles for footwear.

2. Description of the Related Art

Typical footwear (e.g., sandals, shoes, boots) is designed with little or no attention to providing proper support to the wearer's foot. This is particularly true for wearers who may have foot abnormalities or deformities.

Such problems can be addressed using orthotic inserts (also referred to as "orthotics"), which are devices placed in footwear to cooperate with the plantar surfaces of a wearer's feet to provide various levels of support to enhance comfort and/or compensate for foot abnormalities or deformities. Examples of orthotic inserts are found in U.S. Pat. No. 6,976,322 (the entire content of which is incorporated by reference), and inserts offered by Superfeet Worldwide, Inc. of Ferndale, Wash. USA.

The ability to remove orthotic inserts is advantageous because it allows wearers to conveniently swap inserts from one pair of shoes to another, for example. On the other hand, removable inserts can be easily misplaced or lost. In addition, orthotic inserts can become dislodged or misaligned during use, thereby diminishing their effectiveness.

BRIEF SUMMARY

The footwear having orthotic midsoles described herein is configured to provide enhanced support and may compensate for various foot abnormalities or deformities in a particularly robust and durable form factor.

At least one embodiment of footwear having an orthotic midsole may be summarized as a composite sole structure including an orthotic shell received between a midsole platform and an insole. The orthotic shell may be completely enclosed between the midsole platform and the insole such that the orthotic shell is not externally visible when the footwear is completely assembled. The orthotic shell is preferably about three-quarters of an entire longitudinal length of the footwear and made of a semi-rigid material that is relatively more rigid than a material of the midsole platform. The orthotic shell includes a heel portion to support a heel of a foot of a wearer and a forefoot portion to support a forefoot of the wearer at least in a region behind and near metatarsal heads of the foot. A central or midfoot portion extends between the heel portion and the forefoot portion and generally corresponds to the plantar surfaces of a typical wearer's midfoot, including, for example, an arch of the foot. The orthotic shell may be shaped to support the metatarsal heads in a neutral, generally horizontal position. Alternatively, the orthotic shell may be shaped to support the metatarsal heads in a progressively elevated position from one side of the forefoot toward an opposing side of the forefoot to simulate a forefoot valgus wedge (forefoot everted relative to rear foot position) or a forefoot varus wedge (forefoot inverted relative to rear foot position).

A plurality of support plugs may be positioned within the midsole platform to help to stabilize the orthotic shell in a semi-rigid position. The support plugs may extend through the midsole platform from a lower surface thereof to an opposing upper surface to come into contact with underside surfaces of the orthotic shell. The support plugs may cooperate to provide a multi-point contact structure, such as, for example, a contact structure having three, four, five or more points of contact, to hold the orthotic shell in a particularly stable manner. For instance, a pair of supports may be positioned to underlie the forefoot portion of the orthotic shell at medial and lateral sides thereof. Another pair of support plugs may be positioned to underlie the heel portion of the orthotic shell at medial and lateral sides thereof. The number of support plugs and durometer of the same may vary to provide different levels of support and comfort.

A shank is preferably coupled to the midsole platform to increase structural flexural and torsional rigidity of the footwear and provide a foundation for the support plugs. The support plugs may be positioned to span completely between portions of the shank and the orthotic shell. For example, in a four-point contact arrangement, a separate projection or arm extending from a central portion of the shank may underlie each of the support plugs which in turn contact and support the orthotic shell. More particularly, a projection of the front portion of the shank may extend along a lateral side of the footwear to underlie a region of the midsole platform behind and near a contact area corresponding to the metatarsal head of the fifth metatarsal of the foot. Another projection may extend along a medial side of the footwear to underlie a region of the midsole platform behind and near a contact area corresponding to the metatarsal head of a first metatarsal of the foot. Support plugs may be provided on these projections to semi-rigidly support the forefoot portion of the orthotic shell at medial and lateral positions. Similarly, projections may extend from the central portion of the shank toward the rear end of the footwear along lateral and medial sides of the footwear, respectively, to underlie areas transversely offset from a contact area corresponding to the posteriorly lateral aspect of the heel of the foot. Support plugs may be provided on these projections to semi-rigidly support the heel portion of the orthotic shell at medial and lateral positions. The support plugs are preferably made of a material having less pliancy than the surrounding midsole platform to reduce a compression rate of the midsole relative to a midsole formed entirely of ethylene vinyl acetate (also known as EVA) or a similar material.

Various components of the composite sole may assist in providing a wedging effect when the footwear is configured to support a wearer's forefoot in a forefoot valgus or forefoot varus position. For example, as previously discussed, the orthotic shell itself may be shaped to support the distal aspect of the metatarsal shafts proximal to the metatarsal heads in a progressively elevated position from one side of the forefoot toward an opposing side of the forefoot to simulate a forefoot valgus wedge (forefoot everted, relative to rear foot position) or a forefoot varus wedge (forefoot inverted, relative to the rear foot position). In addition, a portion of the front end of the shank may vary progressively in thickness from one side thereof to an opposing side thereof to create a wedge underlying the forefoot portion of the orthotic shell to simulate a forefoot valgus wedge (forefoot everted, relative to rear foot position) or forefoot varus wedge (forefoot inverted, relative to rear foot position). Alternatively, the midsole platform itself or an insertable support structure received therein may vary progressively in thickness from one side thereof to an opposing side thereof to create a wedge underlying the forefoot portion of the orthotic shell.

Accordingly, when the footwear is worn by the wearer, one or more of the components of the sole may assist in supporting the foot such that a plane generally defined by the metatarsal heads of the foot is inclined with respect to a horizontal transverse plane with a lateral side of the forefoot supported in a more elevated position than a medial side of the forefoot to create or simulate a forefoot valgus wedge. Conversely, when the footwear is worn by the wearer, the plane generally defined by the metatarsal heads of the foot may be inclined with respect to a horizontal transverse plane with a medial side of the forefoot supported in a more elevated position than a lateral side of the forefoot to create or simulate a forefoot varus wedge. The plane defined just proximal to the metatarsal heads may be inclined between about 3 to 4 degrees to accommodate for a moderate forefoot valgus or forefoot varus, or the forefoot may be inclined more aggressively, such as, for example, between about 4 to 8 degrees to accommodate for a more extreme forefoot valgus or forefoot varus.

The footwear may also be formed to include several additional features to facilitate natural flexing of the foot during use. For instance, the midsole platform may include a flex groove extending across a width thereof in a position and orientation corresponding generally to a reference line defined by metatarsal phalangeal joints of the foot. In this manner, the flex groove can facilitate a natural bending of the foot at the metatarsal phalangeal joints. As another example, the shape of a front portion of the midsole platform may gradually rise to form a toe rocker feature to facilitate rolling contact of the sandal with the ground or other surface. Additionally, a rear lateral portion of the midsole platform may include an angled heel strike portion to facilitate rolling contact as the rear end of the sandal strikes the ground during use.

The various aspects and features described above and other aspects and features described herein may be combined to provide footwear that is particularly well adapted to support the foot of a wearer in a stable manner while also allowing the foot to flex naturally during use. It is appreciated that these aspects and features may be applied to a wide range of footwear, including without limitation, athletic shoes, casual shoes, dress shoes, work boots and recreational footwear such as snowboard boots and ski boots.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures and manufacturing techniques associated with footwear and orthotic devices may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
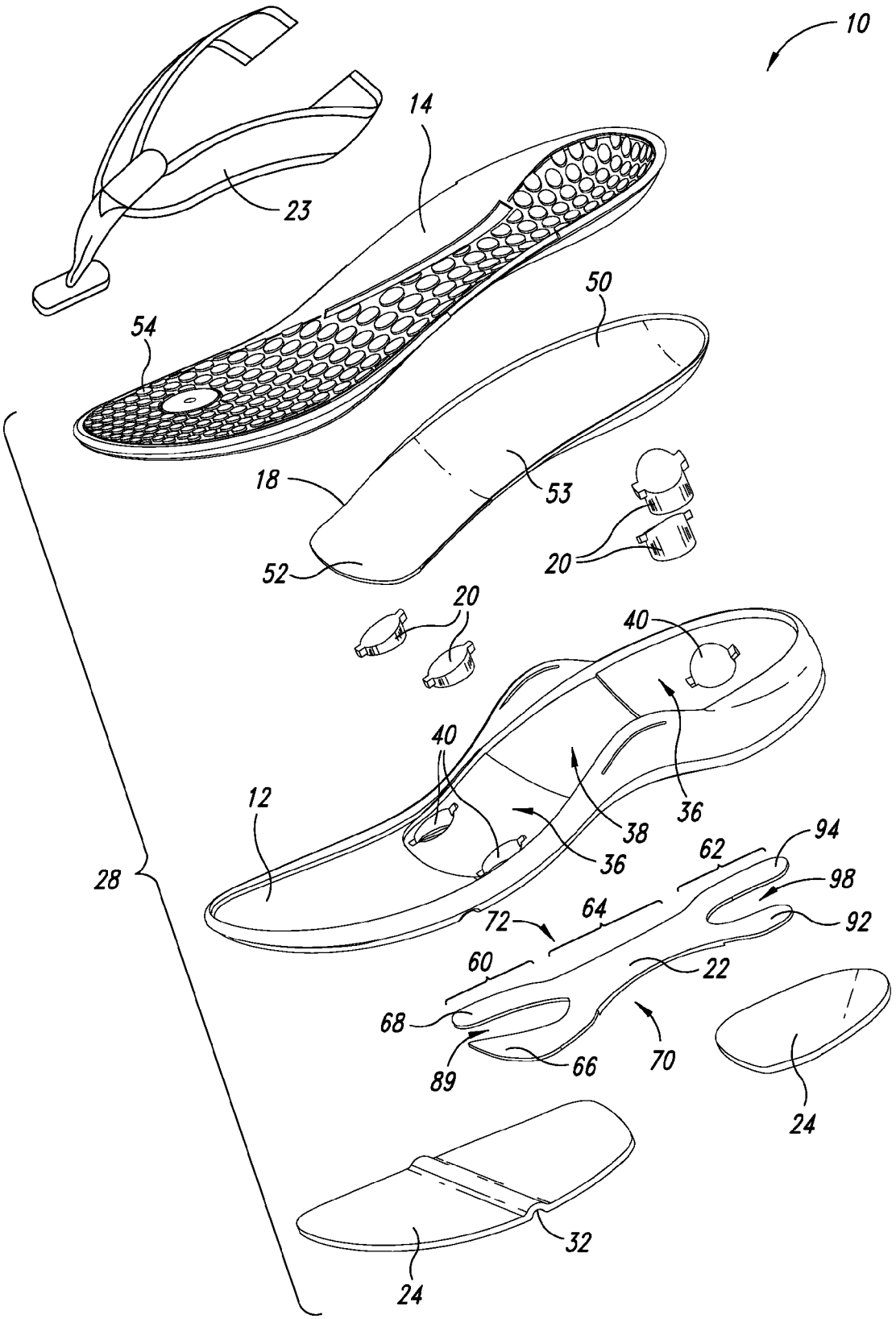
FIG. 1 is an isometric exploded view of footwear in the form of a sandal, according to one embodiment.
Figure 2:
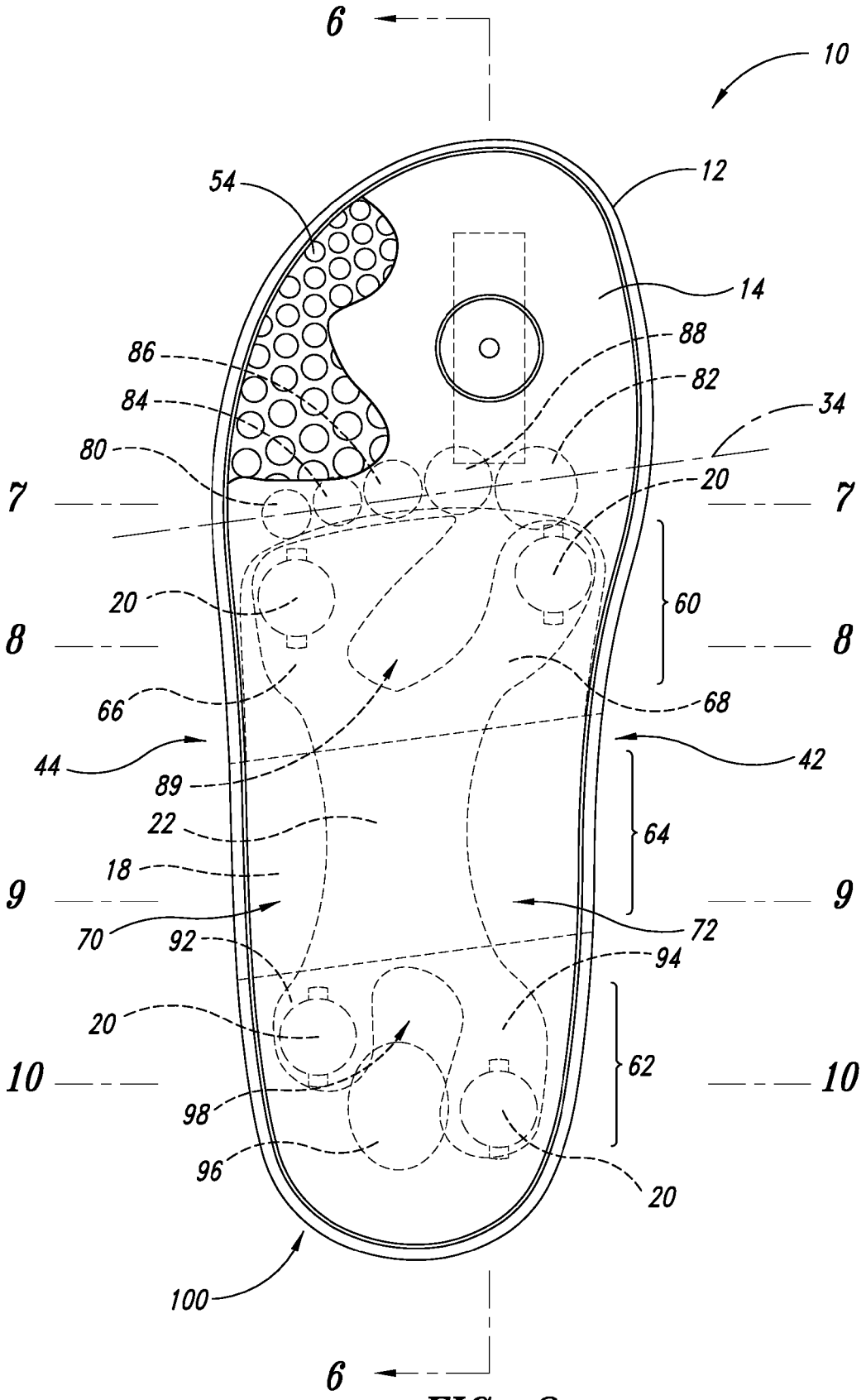
FIG. 2 is top plan view of a composite sole of the sandal of FIG. 1.
Figure 3:
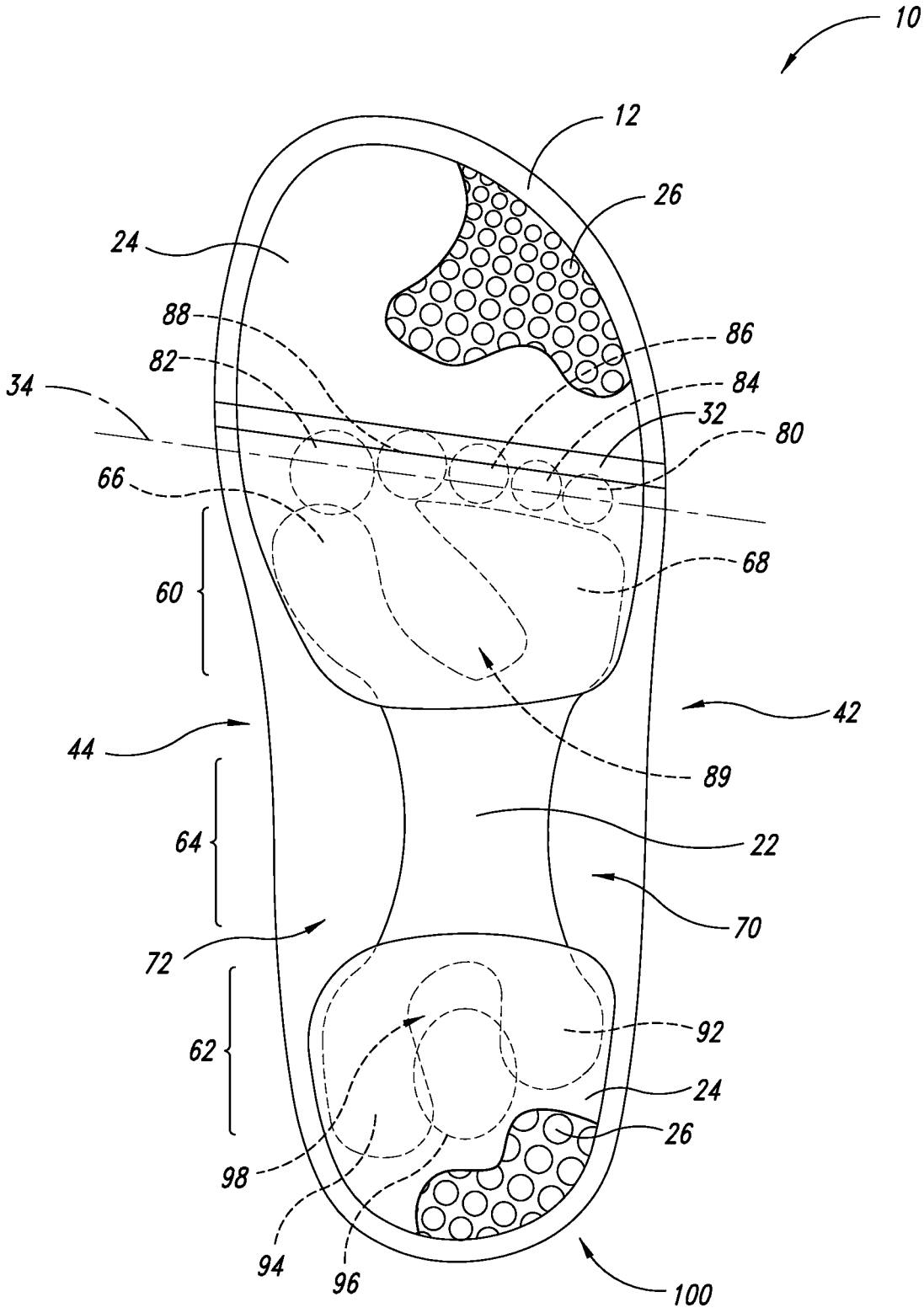
FIG. 3 is bottom plan view of the composite sole of the sandal of FIG. 1.
Figure 4:
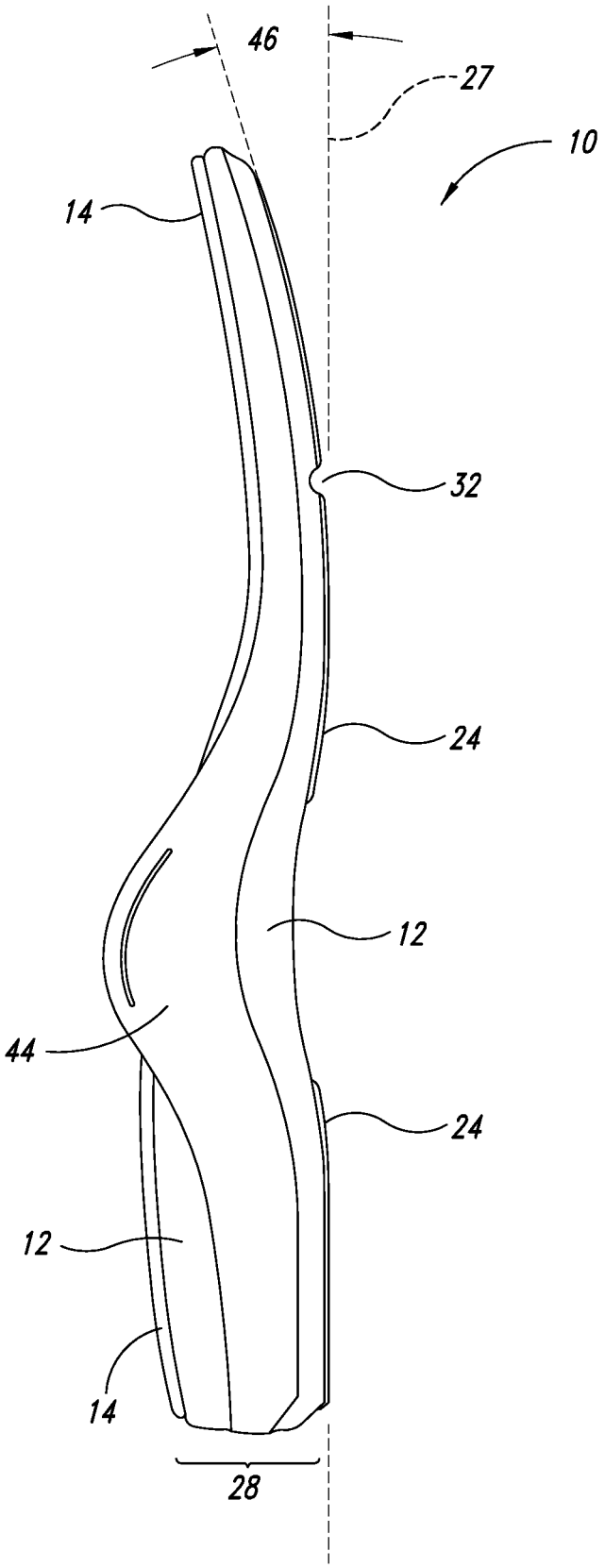
FIG. 4 is a side elevational view of a medial side of the composite sole of the sandal of FIG. 1.
Figure 5:
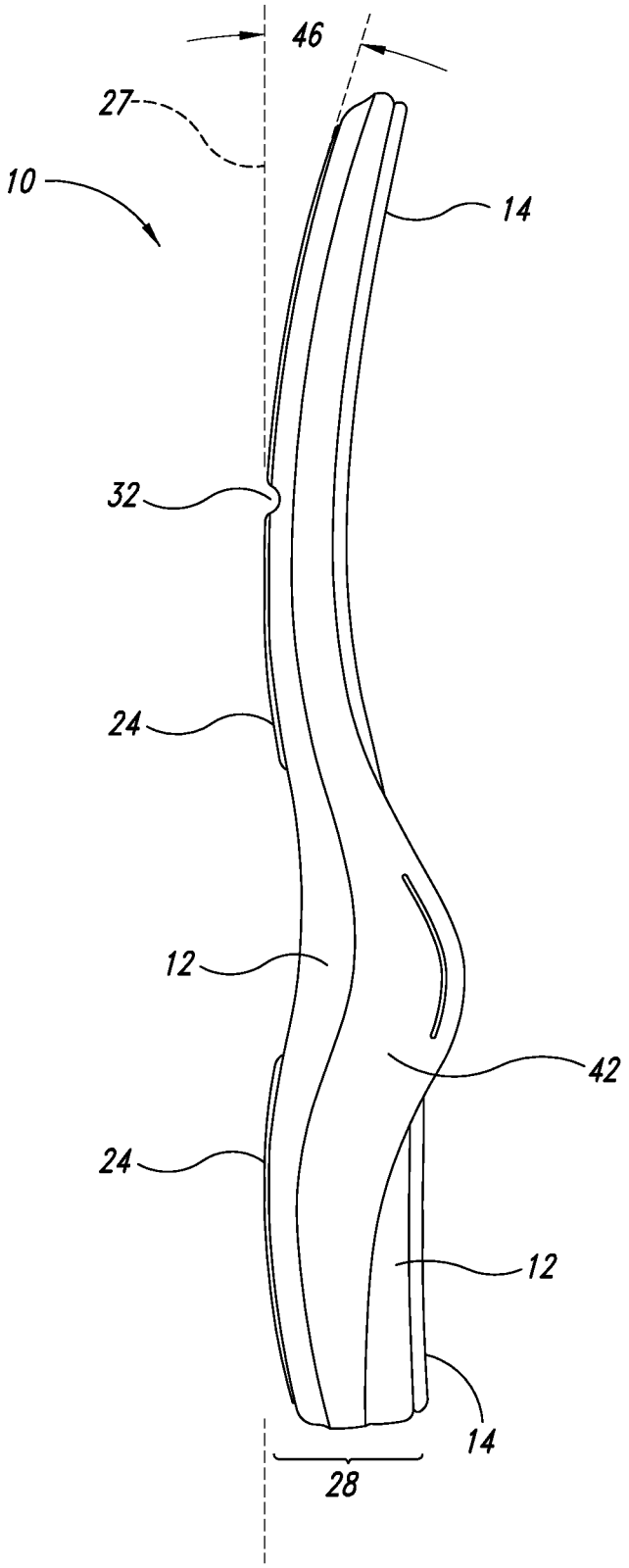
FIG. 5 is a side elevational view of a lateral side of the composite sole of the sandal of FIG. 1.

FIG. 1 shows an exploded view of footwear in the form of a sandal 10 according to one embodiment, and in particular, a left sandal illustration of a mating pair of sandals. The sandal 10 includes a midsole platform 12 and a full length insole 14. An orthotic midsole in the form of an orthotic shell 18 is provided to be received between the midsole platform 12 and the full length insole 14. The sandal 10 further includes a plurality of support plugs 20 to contact and support the orthotic shell 18 in a determined orientation and a shank 22 to provide enhanced structural flexural and torsional rigidity with respect to a longitudinal length of the sandal 10. An upper or vamp in the form of retention straps 23 are provided for holding the sandal 10 to the foot of a wearer. The retention straps 23 can be a material featuring multi-directional stretching capability to provide enhanced comfort and durability. In some embodiments, such as the illustrated embodiment of FIG. 1, the midsole platform 12 may serve as a midsole of the sandal 10 with a separate outsole or outsoles 24 coupled to a bottom surface thereof, such as, for example, by adhesive.

Further details of the sandal 10 and components thereof are further shown and described with additional reference to FIGS. 2 through 11.

Figure 6:
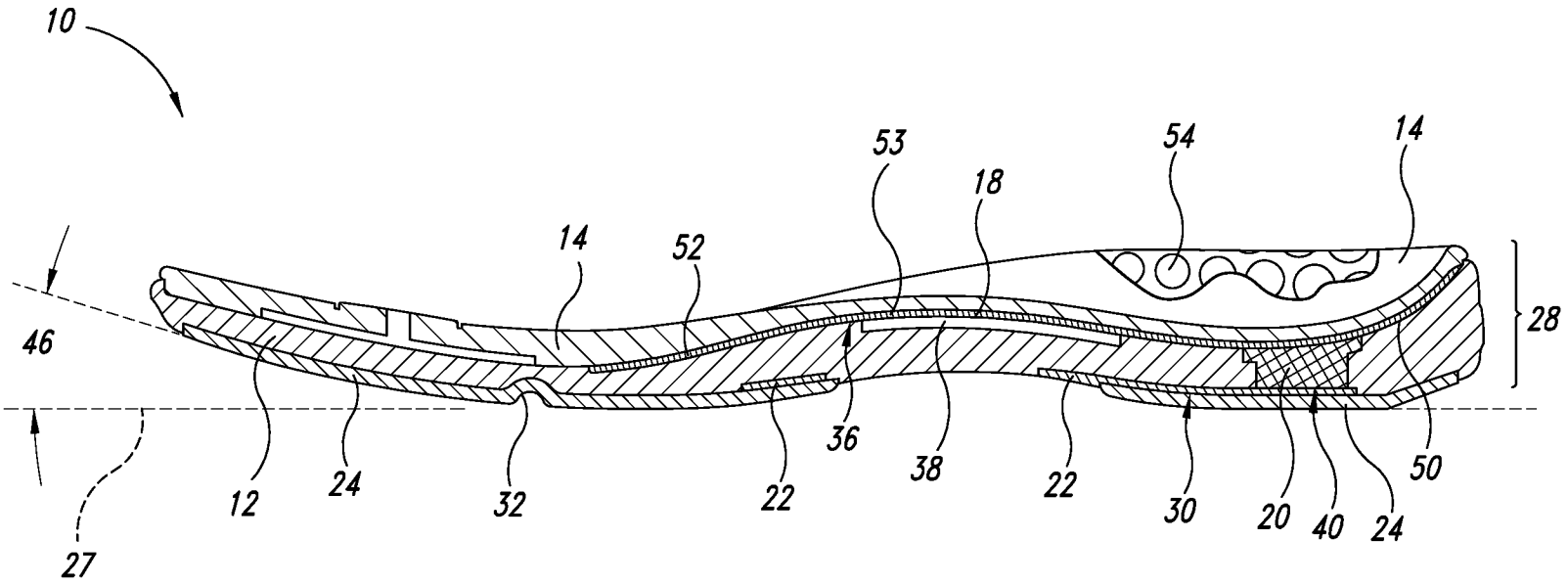
FIG. 6 is a cross-sectional view of the composite sole of the sandal of FIG. 1 taken along line 6-6.
Figure 7:
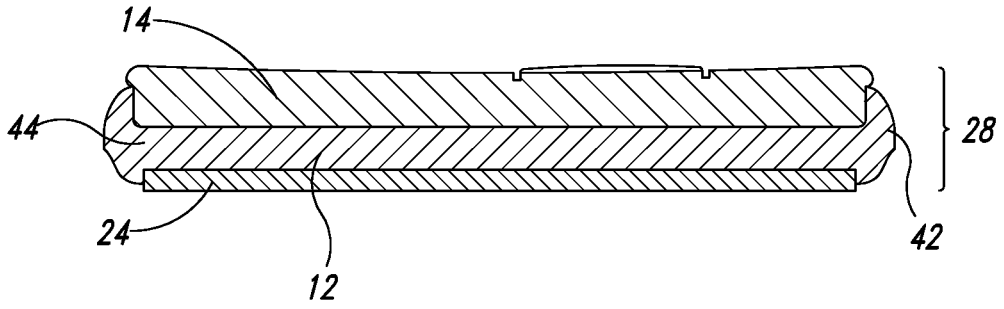
FIG. 7 is a cross-sectional view of the composite sole of the sandal of FIG. 1 taken along line 7-7.
Figure 8:
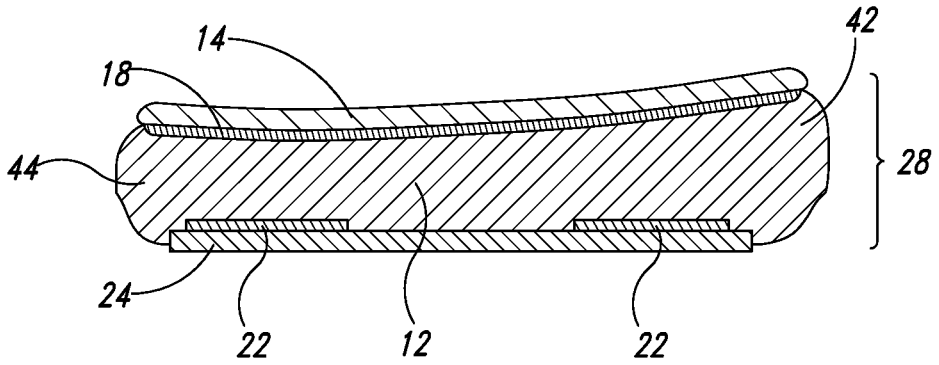
FIG. 8 is a cross-sectional view of the composite sole of the sandal of FIG. 1 taken along line 8-8.
Figure 9:
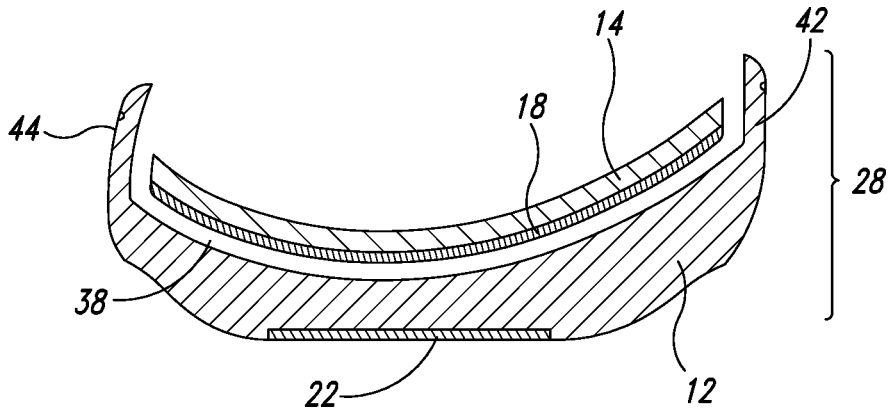
FIG. 9 is a cross-sectional view of the composite sole of the sandal of FIG. 1 taken along line 9-9.
Figure 10:
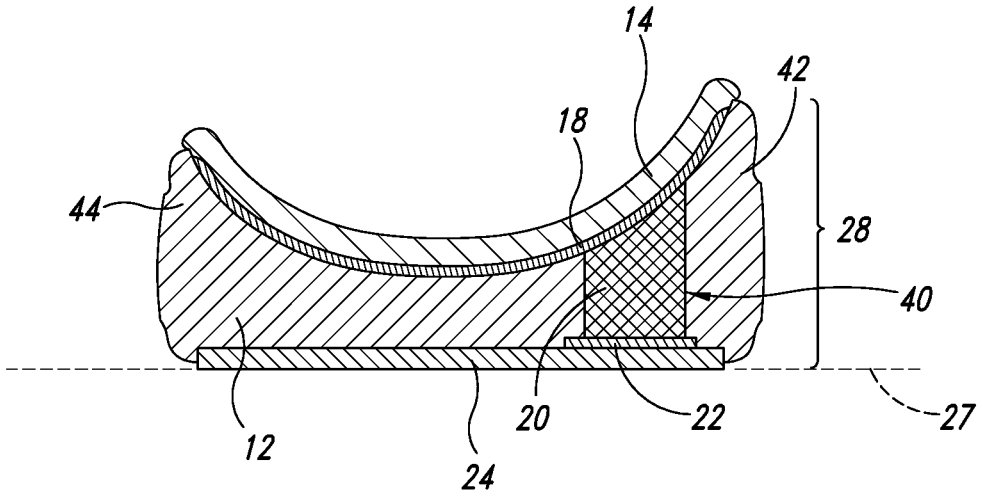
FIG. 10 is a cross-sectional view of the composite sole of the sandal of FIG. 1 taken along line 10-10.

According to the illustrated embodiment, the sandal 10 is constructed such that the midsole platform 12 serves as part of a midsole assembly with outsoles 24 coupled to the bottom surface thereof at a front and rear portion of the sandal 10. The outsoles 24 can include tread patterns 26 thereon to enhance traction between the sandal 10 and a ground or other surface, as represented by line 27 (FIG. 6). In other embodiments, the midsole platform 12 may serve directly as the outsole and include a tread pattern formed thereon to enhance traction between the sandal 10 and a ground surface.

The midsole platform 12 is a component of the entire composite sole 28 which includes the midsole platform 12, the full length insole 14, the orthotic shell 18, support plugs 20, shank 22 and any outsole(s) 24 that may be provided. The midsole platform 12 and other components of the composite sole 28 are sized to comfortably receive a wearer's foot of a given size (e.g., size 10 or 11) as is typical of sandals and other footwear. The midsole platform 12 is preferably made of a generally flexible yet resilient, shock absorbing material, such as, for example, ethylene vinyl acetate (also known as EVA) or similar materials.

Various structures or features may be molded into or otherwise provided in the midsole platform 12. For example, a shank recess 30 may be provided on the bottom surface of the midsole platform 12 to closely receive the shank 22 therein. Also, a flex groove 32 or other relief may be provided in a forefoot region of the midsole platform 12 to facilitate bending of the sandal 10 at a location generally corresponding to metatarsal phalangeal joints of the foot. In some embodiments, the flex groove 32 may be oriented between about 7 and 9 degrees from a transverse direction of the sandal 10 to correspond generally to a reference line 34 defined by the metatarsal heads, as shown best in FIG. 3. The midsole platform 12 may also include a recessed bed portion 36 correspondingly shaped to a lower surface of the orthotic shell 18. An additional recess 38 may also be provided in the recessed bed portion 36 to accommodate a portion of a retention strap 23 or similar device for securing the sandal 10 to the foot. Still further, indentations, cavities, voids, apertures 40 or similar features may be provided to accommodate the support plugs 20 in the sandal 10.

For example, in the illustrated embodiment, four distinct plug apertures 40 extend through the midsole platform 12 from a lower surface thereof to an opposing upper surface. The plug apertures 40 are spaced generally at fore and aft positions within the recessed bed portion 36 on medial 42 and lateral sides 44 of the sandal 10. In this manner, the support plugs 20 received in the plug apertures 40 provide a four point contact system to allow the orthotic shell 18 to rest suspended on or above portions of the midsole platform 12. The support plugs 20 may absorb a predominate amount of force under various loading conditions and slow down the compression rate of the sandal 10 relative to a sole made entirely of EVA or a similar material, for example.

The shape of the midsole platform 12 at a front portion may gradually rise to form a toe rocker feature to facilitate rolling contact of the sandal with the ground or other surface. For example, the front portion of the midsole platform 12 may have an inclination angle 46 of about 5 to 10 degrees. A rear lateral portion 100 of the midsole platform 12 may include an angled heel strike portion to facilitate rolling contact as the rear end of the sandal 10 strikes the ground. For example, in some embodiments a heel strike may be provided having an inclination angle of about 15 to 18 degrees.

As previously described, an orthotic midsole in the form of an orthotic shell 18 is received between the midsole platform 12 and the full length insole 14 and supported in a determined orientation. The orthotic shell 18 is preferably about three-quarters of a longitudinal length of the footwear as illustrated, however, longer or shorter orthotic shells 18 may be used. As shown best in FIGS. 1 and 6, the orthotic shell 18 includes a heel portion 50 to support a heel of a foot of a wearer and a forefoot portion 52 to support a forefoot of the wearer behind and near metatarsal heads of the foot. A central or midfoot portion 53 extends between the heel portion 50 and the forefoot portion 52. The midfoot portion 53 generally corresponds to the plantar surfaces of a typical wearer's midfoot, including, for example, an arch of the foot.

Figure 12:
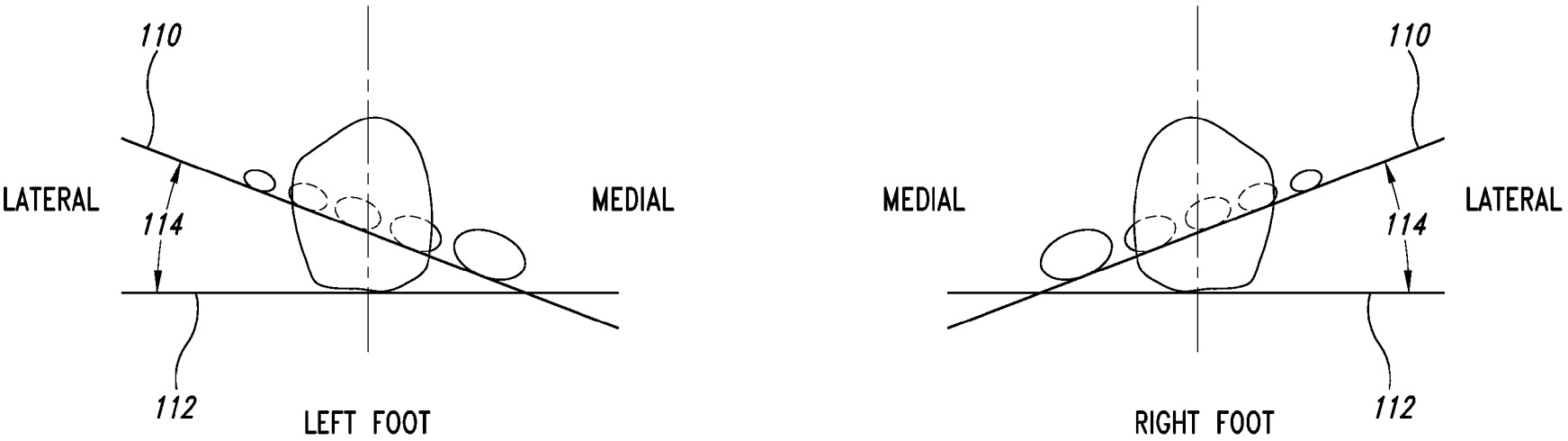
FIG. 12 is a diagram of a wearer's foot illustrating a possible everted support position of a forefoot enabled by some embodiments of the footwear and components described herein.
Figure 13:
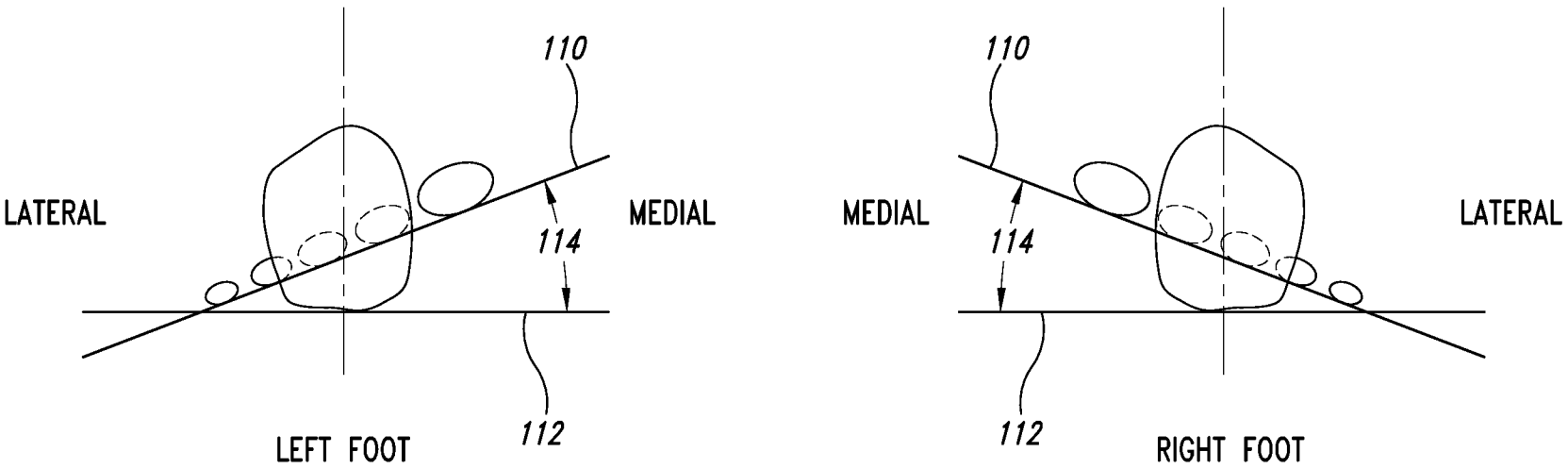
FIG. 13 is a diagram of a wearer's foot illustrating a possible inverted support position of a forefoot enabled by some embodiments of the footwear and components described herein.

The orthotic shell 18 is shaped such that, when it is supported at the determined orientation, the heel portion 50 partially cups the wearer's heel to support the same in a generally vertical orientation. Simultaneously, the forefoot portion 52 supports the forefoot such that the metatarsal heads are supported in a neutral, generally horizontal manner. In other embodiments, the orthotic shell 18 may include a forefoot portion shaped such that a plane 110 generally defined by the metatarsal heads of the foot is inclined with respect to a horizontal transverse plane 112 so that a lateral side of the forefoot is supported in a more elevated position than a medial side of the forefoot to simulate a valgus wedge, as illustrated in FIG. 12. In other embodiments, the orthotic shell 18 may include a forefoot portion shaped such that the plane 110 generally defined by the metatarsal heads of the foot is inclined with respect to the horizontal transverse plane 112 so that a medial side of the forefoot is supported in a more elevated position than a lateral side of the forefoot to simulate a varus wedge, as illustrated in FIG. 13.

Accordingly, the orthotic shell 18 may be shaped and oriented to support the forefoot of the wearer in an angled orientation relative to a horizontal transverse plane 112 underlying the heel to compensate for abnormalities or deformities in the foot and surrounding joints, such as, for example, forefoot valgus and forefoot varus conditions. The valgus wedge shape portion or varus wedge shape portion of the orthotic shell 18 in these embodiments would be designed into an upper portion of the orthotic shell 18 at a front end thereof such as to be in direct contact with the forefoot. In some embodiments, the forefoot may be everted slightly, such as, for example, between about 3 to 4 degrees to accommodate for a moderate forefoot valgus. In other embodiments, the forefoot may be everted more aggressively, such as, for example, between about 4 to 8 degrees to accommodate for a more extreme forefoot valgus. In still other embodiments, the forefoot may be everted less than 3 degrees or more than 8 degrees. Conversely, in some embodiments, the forefoot may be inverted slightly, such as, for example, between about 3 to 4 degrees to accommodate for a moderate forefoot varus. In other embodiments, the forefoot may be inverted more aggressively, such as, for example, between about 4 to 8 degrees to accommodate for a more extreme forefoot varus. In still other embodiments, the forefoot may be inverted less than 3 degrees or more than 8 degrees.

The orthotic shell 18 may vary in shape, thickness, material and other aspects. In general, however, the orthotic shell 18 should extend at least to a region behind and near the metatarsal heads of a wearer's foot. In some embodiments, the orthotic shell 18 may extend beyond the metatarsal heads to provide a stronger lever arm to support the wearer's foot; however, extending the orthotic shell 18 in this manner may require additional cushioning or protection at or near the front end of the orthotic shell 18 to protect against potential discomfort as the ball of the foot interacts with the orthotic shell 18.

The orthotic shell 18 is preferably made of a material having a greater rigidity than a material of the midsole platform 12, although materials having less rigidity may be beneficial for some applications. In one embodiment, the orthotic shell 18 is made of a semi-rigid composite including ballistic nylon.

The orthotic shell 18 may be affixed between the midsole platform 12 and full length insole 14 with adhesives or the like, or may be removably received therebetween. As shown in the illustrated embodiment, the orthotic shell 18 may be substantially entirely enclosed between the full length insole 14 and the midsole platform 12 such that the orthotic shell 18 is not externally visible when the sandal 10 is completely assembled. The full length insole 14 covering the orthotic shell 18 may include surface texture 54 or design features such that the sandal 10 has a comfortable feel when worn.

In order to support the orthotic shell 18 in the determined orientation in a particularly stable manner, the sandal 10 may include a plurality of support plugs 20 received within the midsole platform 12, as previously indicated. In the illustrated embodiment, the support plugs 20 are in the form of upstanding, generally cylindrical plugs which are insertably and removably coupled to the midsole platform 12. Accordingly, the midsole platform 12 may include a corresponding number of apertures 40, cavities or the like which are shaped to closely receive the support plugs 20. The apertures 40 and support plugs 20 may be keyed to locate and orient the support plugs 20 in and relative to the midsole platform 12.

According to one embodiment, the support plugs 20 are less pliant than the surrounding structure of the midsole platform 12 yet remain deformable to absorb and return shock energy when the sandal 10 is in use. In other words, a rigidity of the support plugs 20 can be greater than a rigidity of the midsole platform 12, yet sufficiently pliant to absorb energy when impacted. In this manner, the support plugs 20 are particularly well adapted to rigidly support the orthotic shell 18 while also being adapted to absorb force loads when in use.

The selected pliancy of the support plugs 20 may vary according to, among other factors, the type of footwear (e.g., athletic footwear, casual footwear) and size of footwear. For example, larger size footwear may include less pliant support plugs 20 than smaller size footwear. The pliancy of the support plugs 20 may be controlled by selecting materials having different durometers. In one embodiment, the support plugs 20 are made of a material having a durometer at least twenty percent greater than a durometer of the midsole platform 12.

In one embodiment, a medial distal support plug behind the ball of the foot and a lateral proximal plug located to the outside of the heel are of the same material and have a relatively high durometer. In other embodiments, the durometers of either or both of these plugs can be changed to a softer, more pliant support plug. Irrespective of pliancy or hardness, the support plugs 20 are positioned to bridge between the orthotic shell 18 and the shank 22 such that the compression forces going through the midsole platform 12 between and around the support plugs 20 are reduced. This can be advantageous in extending the life of the midsole platform 12 when it is made of EVA, for example, as the EVA material could otherwise bottom out very quickly. The support plugs 20 cooperatively function as a support system to keep the orthotic shell 18 level and balanced with respect to a horizontal transverse plane.

In an alternate embodiment, the support plugs 20 may be integrally formed in the midsole platform 12, such as, for example, via a two-shot injection molding process. In still other embodiments, the midsole platform 12 may not include support plugs 20 received in the midsole platform 12. Instead, the midsole platform 12 may support the orthotic shell 18 directly.

As illustrated best in FIGS. 1 and 6, a shape of an upper surface of each of the support plugs 20 may substantially correspond to a shape of the surface of the orthotic shell 18 overlying the respective support plugs 20. For example, in the illustrated embodiment, the pair of support plugs 20 positioned in the forefoot region of the midsole platform 12 on opposing sides thereof each slope generally downward toward a front end of the sandal 10 and the pair of support plugs 20 positioned in the heel region of the midsole platform 12 on opposing sides thereof each slope generally downward toward a center of the heel region.

In some embodiments, the support plugs 20 will not only serve as contact points for the orthotic shell 18 but will also help to absorb force due to the relatively firmer material of the support plugs 20 as compared to the material of the midsole platform 12, as previously described. For example, in one embodiment, the midsole platform 12 is made of EVA and the support plugs 20 are made of a material having a durometer at least 20 percent greater than the EVA midsole platform, such that the support plugs 20 play a relatively greater role in absorbing force when the footwear is in use. In this manner, the support plugs 20 and midsole platform 12 may cooperate to different degrees to stabilize and support the orthotic shell 18.

Although the support plugs 20 are shown as including four upstanding, generally cylindrical plugs, it is appreciated that the support plugs 20 may vary in number, size, shape and placement. For example, in one embodiment, additional support plugs 20 may be provided in a central region of the sandal. In another embodiment, three plugs may provide a three-point contact support system.

Figure 18:
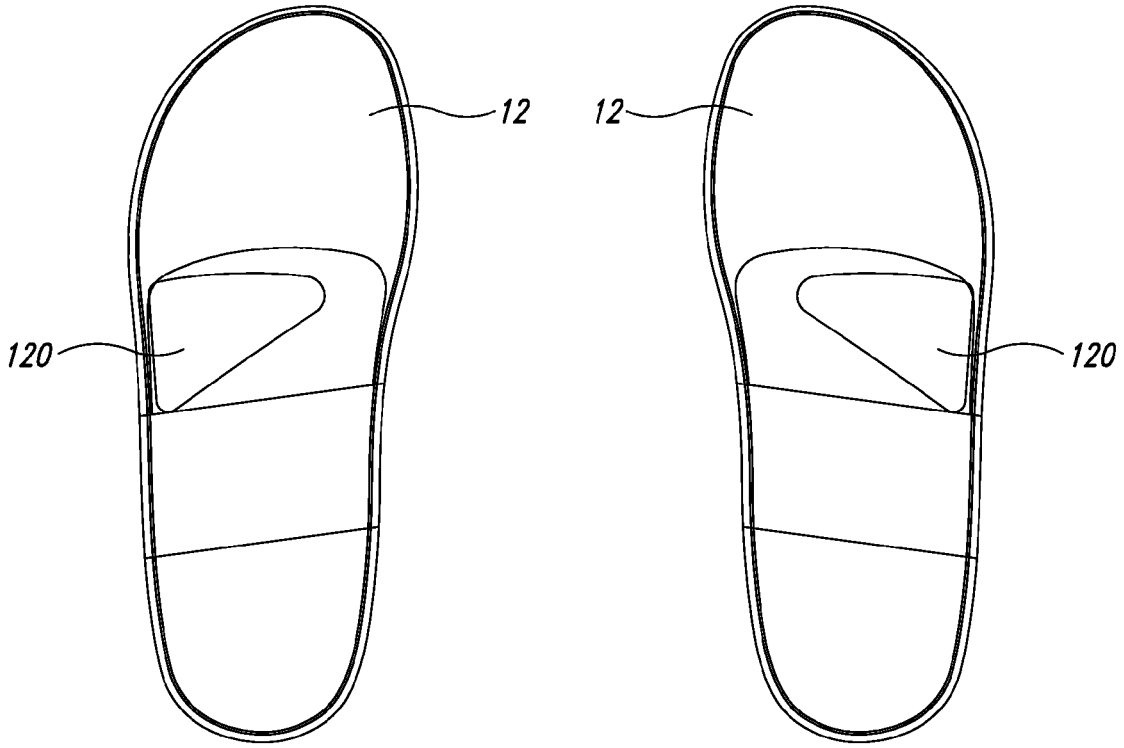
FIG. 18 is a diagram of a midsole illustrating a wedge-shaped support received therein to provide a forefoot wedging effect.
Figure 19:
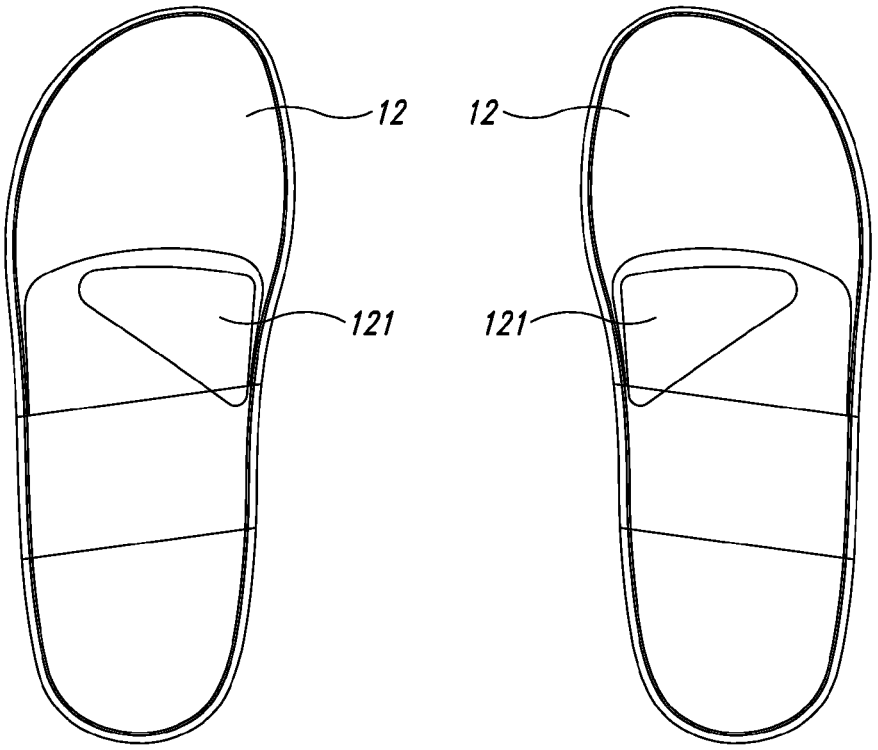
FIG. 19 is another diagram of a midsole illustrating a wedge-shaped support received therein to provide a forefoot wedging effect.

In some embodiments, a single wedge-shaped support plug may be provided in lieu of the generally cylindrical plugs in the forefoot portion of the midsole platform 12 For example, in one embodiment, a single wedge-shaped support insert 120 (FIG. 18) may be provided within the midsole platform 12 in a forefoot portion underlying a lateral side of the wearer's forefoot with the support 120 sloping downward in a direction towards a medial side 42 of the sandal 10 to assist in orienting and supporting the forefoot in a forefoot valgus position, as illustrated in FIG. 12. Conversely, in another embodiment, a single wedge-shaped support insert 121 (FIG. 19) may be provided within the midsole platform 12 in a forefoot portion underlying a medial side of the wearer's forefoot with the support 121 sloping downward in a direction towards a lateral side 44 of the sandal 10 to assist in orienting and supporting the forefoot in a forefoot varus position, as illustrated in FIG. 13. The wedge-shaped support insert 120, 121 in these embodiments may be removably coupled to the front portion 60 of the shank 22 with adhesive or clips, snaps or other coupling structures. In this manner, the wedge-shaped support insert 120, 121 can be interchanged to support the forefoot of a wearer at different angular orientations. The wedge-shaped support insert 120, 121 may extend at least a majority of a transverse distance across the sandal 10, for example, from the lateral side 44 toward the medial side 42 in the case of creating a forefoot valgus wedge (FIG. 18) and from the medial side 42 toward the lateral side 44 in the case of creating a forefoot varus wedge (FIG. 19).

In other embodiments, a portion 118 (FIG. 20) of the midsole platform 12 may increase progressively in thickness with increasing distance away from the medial side of the midsole platform 12 toward the lateral side of the midsole platform 12 to simulate a forefoot valgus wedge. Alternatively, a portion 119 (FIG. 21) of the midsole platform 12 may increase progressively in thickness with increasing distance away from the lateral side of the midsole platform 12 toward the medial side of the midsole platform 12 to simulate a forefoot varus wedge.

As previously described, a shank 22 may be provided to enhance torsional and structural flexural rigidity with respect to a longitudinal length of the sandal 10. The shank 22 may include a front portion 60, a rear portion 62 and a central portion 64. As shown best in FIGS. 1 through 3, the front portion 60 may include a lateral projection 66 and a medial projection 68 extending from the central portion 64, the lateral projection 66 generally located along a lateral side 70 of the shank 22 and the medial projection 68 generally located along a medial side 72 of the shank 22. The lateral projection 66 of the shank 22 is generally positioned to underlie a region of the midsole platform 12 behind and near a contact area 80 corresponding to at least the metatarsal head of a fifth metatarsal of the foot of a wearer. In a similar manner, the medial projection 68 of the shank 22 is positioned to underlie a region of the midsole platform 12 behind and near a contact area 82 of the metatarsal head of a first metatarsal of the foot. A support plug 20 may be positioned between each of the lateral projection 66 and the medial projection 68 of the shank 22 and the orthotic shell 18 to transmit loads applied to the contact areas 80, 82 during use to the lateral projection 66 and medial projection 68. As such, the sandal 10 can advantageously provide structural flexural and torsionally stable footwear as the loads applied to the respective contact areas 80, 82 fluctuate during use. The lateral projection 66 of the front portion 60 of the shank 22 may further extend generally transversely to underlie at least a portion of a region of the midsole platform 12 behind and near contact areas 84, 86 corresponding to the metatarsal heads of a third metatarsal and a fourth metatarsal of the foot, and optionally behind and near a contact area 88 corresponding to the metatarsal head of a second metatarsal of the foot. A gap 89 may be provided between the lateral projection 66 and the medial projection 68 which may advantageously allow the first metatarsal shaft to plantar flex independently of the lateral forefoot at heel raise in the central region of the sandal 10 near this gap 89. This may consequently allow the first metatarsal head to move somewhat independently of the other metatarsal heads, thereby enabling improved forefoot alignment when walking or running, for example. In addition, the gap 89 or cutout of the shank 22 in the front portion 60 reduces material weight.

The rear portion 62 of the shank 22 may include a lateral projection 92 and a medial projection 94 extending from the central portion 64. The lateral projection 92 may be located along the lateral side 70 of the shank 22 to underlie a first area of the midsole platform 12 transversely offset from a contact area 96 corresponding to the heel area of the foot. The medial projection 94 may be located along the medial side 72 of the shank 22 to underlie another area of the sole transversely offset from the contact area 96 corresponding to the heel area of the foot. In this manner, a gap 98 in the shank 22 may be provided between the lateral projection 92 and the medial projection 94 generally beneath the heel area. The contact area 96 is further distal and lateral such that the shank 22 does not significantly interfere with the compression of the midsole platform 12 at the point of heel contact during normal loading conditions in a region beneath and posteriorly lateral the heel area. The lateral projection 92 and the medial projection 94 are sufficiently near the contact area 96, however, to provide torsional stability when differential loads are applied to the lateral projection 92 and the medial projection 94 of the shank 22 during use. Similar to the discussion above, a support plug 20 may be positioned between each of the lateral projection 92 and the medial projection 94 of the shank 22 and the orthotic shell 18 to transmit loads applied to the orthotic shell 18 to the rear portion 62 of the shank 22. In addition, the gap 98 or cutout of the shank 22 in the rear portion 62 reduces material weight.

In some embodiments, the medial projection 94 of the rear portion 62 of the shank 22 may extend in a longitudinal direction further toward a rear end of the sandal 10 than the lateral projection 92. This is advantageous because extending the projection 92 on the lateral side 70 to the same distance as that of the projection 94 on the medial side 72 might otherwise interfere with the rolling contact that is typically experienced at the lateral rear portion 100 of footwear when walking, for example, because the lateral part of the heel contacts first.

Figure 11:
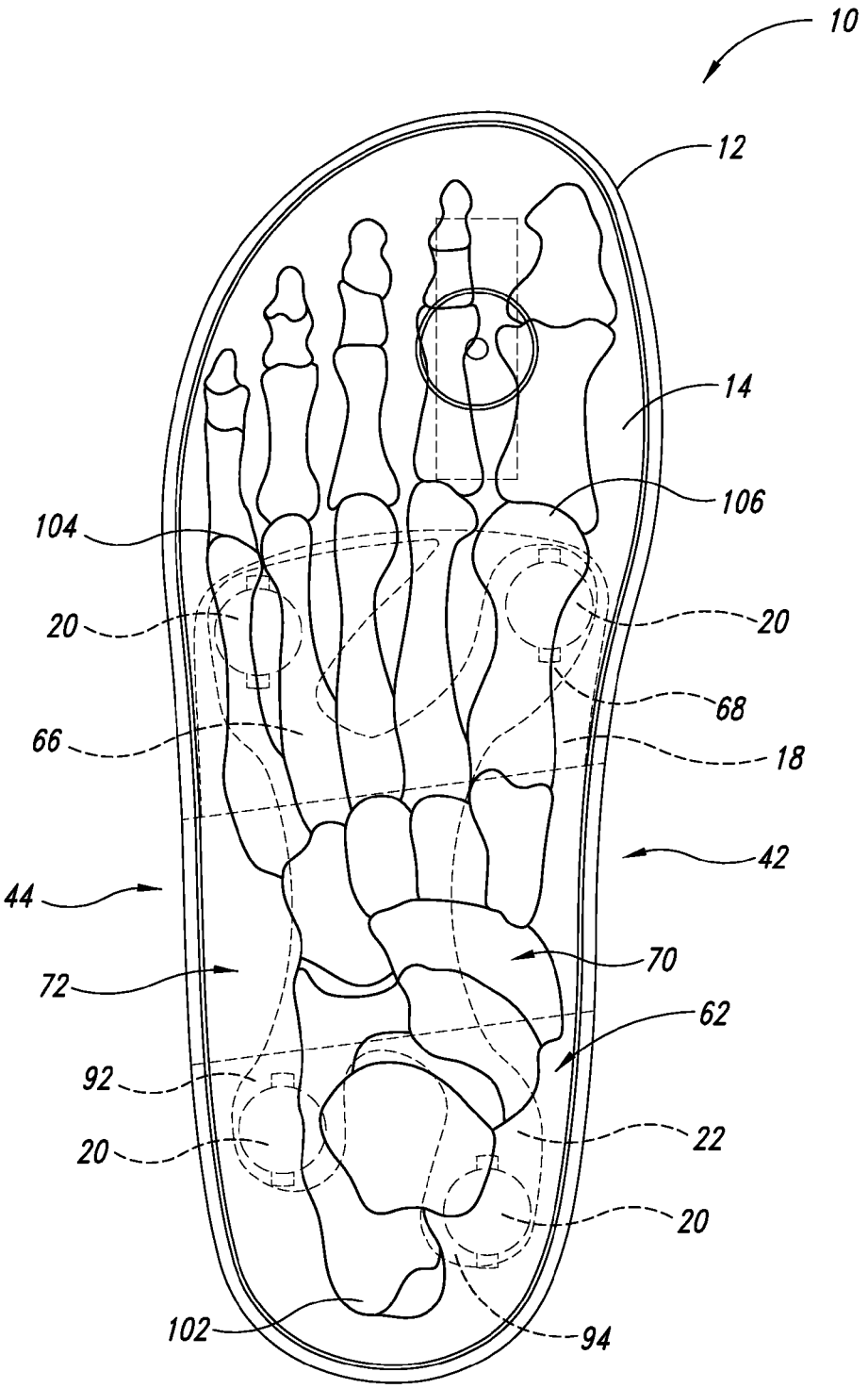
FIG. 11 is the top plan view of FIG. 2 superimposed with a skeletal diagram of a wearer's foot.

FIG. 11 further illustrates the approximate relationship between the skeletal foot structure of a wearer and the components of the sandal 10, including in particular the orthotic shell 18, the shank 22 and support plugs 20 located therebetween. As shown, the calcaneous 102 of the wearer is intended to fall within the cup structure of the orthotic shell 18 between the lateral projection 92 and the medial projection 94 of the rear portion 62 of the shank 22 and support plugs 20 corresponding thereto. The lateral projection 66 and the medial projection 68 of the front portion 60 of the shank 22 and support plugs 20 corresponding thereto underlie behind and near contact regions of the metatarsal heads of the fifth and first metatarsals 104, 106. In this manner, the shank 22, support plugs 20 and orthotic shell 18 cooperate to support the foot in a particularly advantageous manner. In general, the foot may be supported in a determined orientation in a relatively rigid manner but with adequate pliancy and resilience to allow the sandal 10 and hence foot to flex in a natural manner when walking or running, for example.

With reference now to FIGS. 12 and 13, diagrams of common forefoot positions in the form of a forefoot valgus position (FIG. 12) and a forefoot varus position (FIG. 13) are illustrated. In the forefoot valgus position, as illustrated in FIG. 12, the forefoot is everted relative to rear foot position such that the lateral side of the forefoot is elevated at a higher position than the medial side of the forefoot. In this manner, a plane 110 generally defined by the metatarsal heads of the foot is inclined with respect to a horizontal transverse plane 112 such that a lateral side of the forefoot is supported in a more elevated position than a medial side of the forefoot.

Conversely, in the forefoot varus position, as illustrated in FIG. 13, the forefoot is inverted, relative to the rear foot position such that the medial side of the forefoot is elevated at a higher position than the lateral side of the forefoot. In this manner, the plane 110 generally defined by the metatarsal heads of the foot is inclined with respect to the horizontal transverse plane 112 such that a medial side of the forefoot is supported in a more elevated position than a lateral side of the forefoot. In order to support the forefoot in these forefoot valgus and forefoot varus positions, embodiments of the footwear and components described herein may include various support structures configured to orient the forefoot accordingly.

Figure 14:
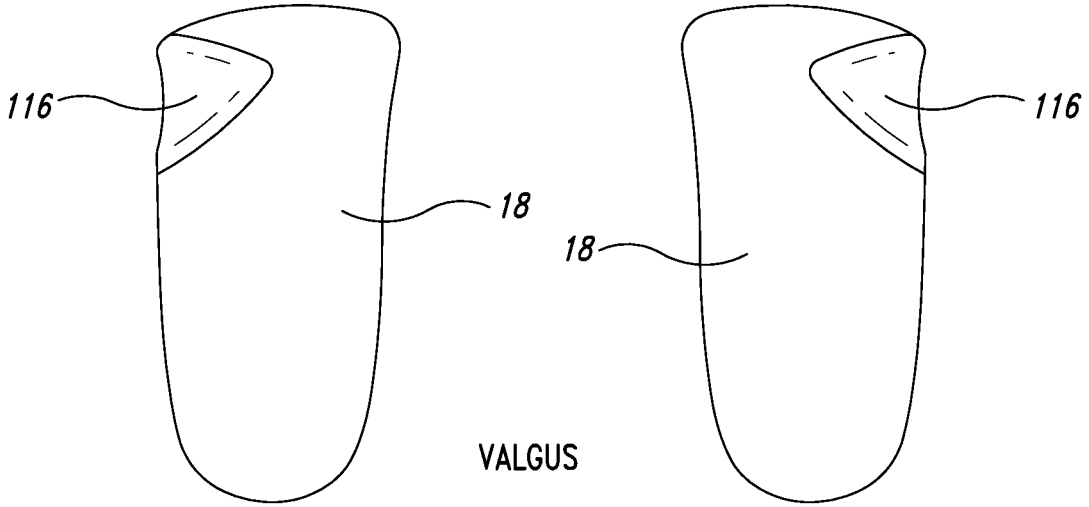
FIG. 14 is a diagram of an orthotic illustrating an area modified to provide a forefoot wedging effect.
Figure 15:
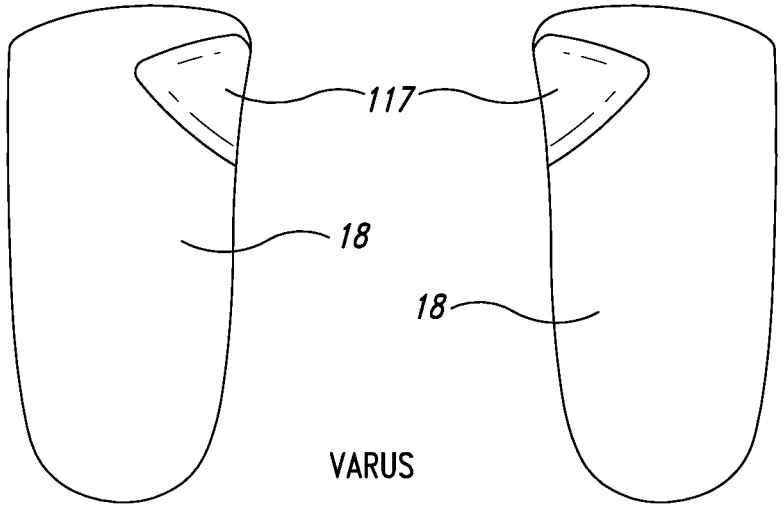
FIG. 15 is another diagram of an orthotic illustrating an area modified to provide a forefoot wedging effect.

For instance, in some embodiments, the orthotic shell 18 received in the sandal 10 may be shaped and oriented to support the forefoot of the wearer relative to the heel to stabilize the forefoot in a forefoot valgus position or a forefoot varus position, rather than a neutral forefoot position. For example, in one embodiment, when the sandal 10 is worn by the wearer, the metatarsal heads of the foot are supported in progressively higher positions with the metatarsal head of the fifth metatarsal being higher than the metatarsal head of the first metatarsal to create or simulate a forefoot valgus wedge for normal function. FIG. 14 illustrates an area 116 in which the upper surface of the orthotic shell 18 may be modified to create this wedging effect. In another embodiment, when the sandal 10 is worn, the metatarsal heads of the foot are supported in progressively higher positions with the metatarsal head of the first metatarsal being higher than the metatarsal head of the fifth metatarsal to create or simulate a forefoot varus wedge for normal function. FIG. 15 illustrates an area 117 in which the upper surface of the orthotic shell 18 may be modified to create this wedging effect.

In other words, in some embodiments, when the sandal 10 is worn by the wearer, a reference plane 110 generally defined transversely across the metatarsal heads of the foot in an initial weight-bearing configuration on a flat, horizontal surface may be configured such that a lateral side of the forefoot is supported higher relative to a medial side of the forefoot. Conversely, in other embodiments, when the sandal 10 is worn by the wearer, the reference plane 110 generally defined transversely across the metatarsal heads of the foot in an initial weight-bearing configuration on a flat, horizontal surface may be configured such that a medial side of the forefoot is supported higher relative to a lateral side of the forefoot. The reference plane may be tilted to a determined angle 114, such as, for example, about 3 to 4 degrees or more. In some embodiments, an axis of rotation of the reference plane may be approximately parallel to the horizontal transverse plane in a direction along the longitudinal length of the sandal, and in other embodiments, may be approximately perpendicular to the reference line 34 illustrated in FIGS. 2 and 3.

Although embodiments have been described as including a plurality of support plugs 20 underlying the forefoot portion of the orthotic shell 18 to support the orthotic shell 18 in a determined orientation, it is also appreciated that a single unitary wedge support structure (e.g., a wedge-shaped support insert or wedge-shaped portion of the midsole platform) or the shank 22 itself may be used to assist in supporting the orthotic shell 18 and ultimately the foot.

Figure 16:
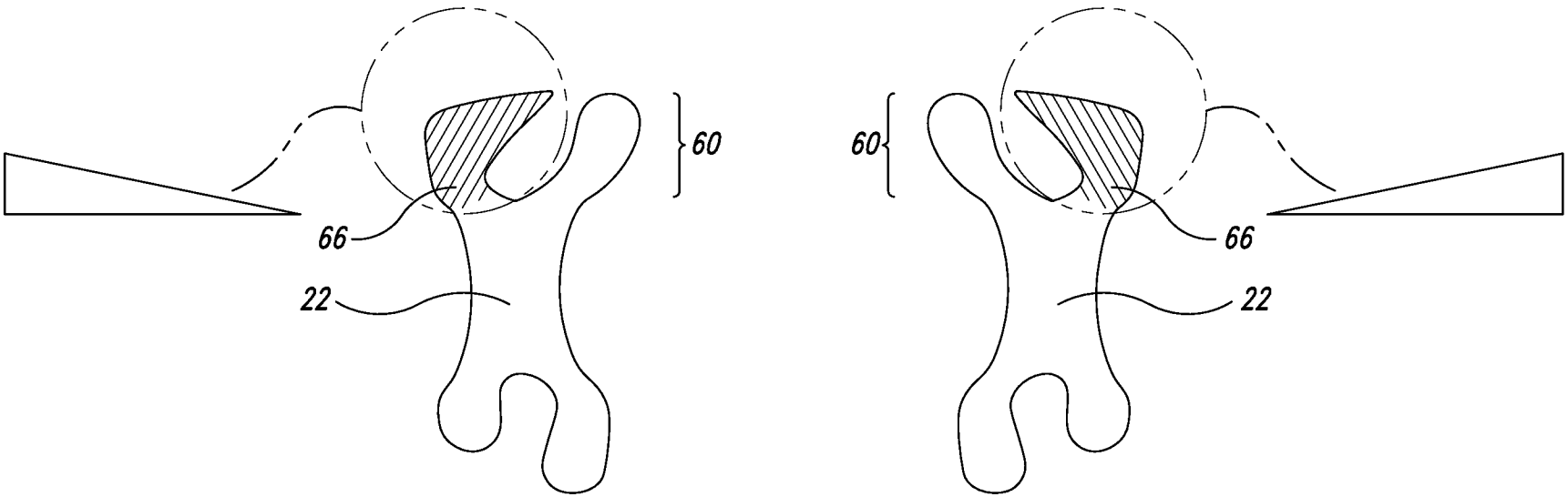
FIG. 16 is a diagram of a shank illustrating an area modified to provide a forefoot wedging effect.
Figure 17:
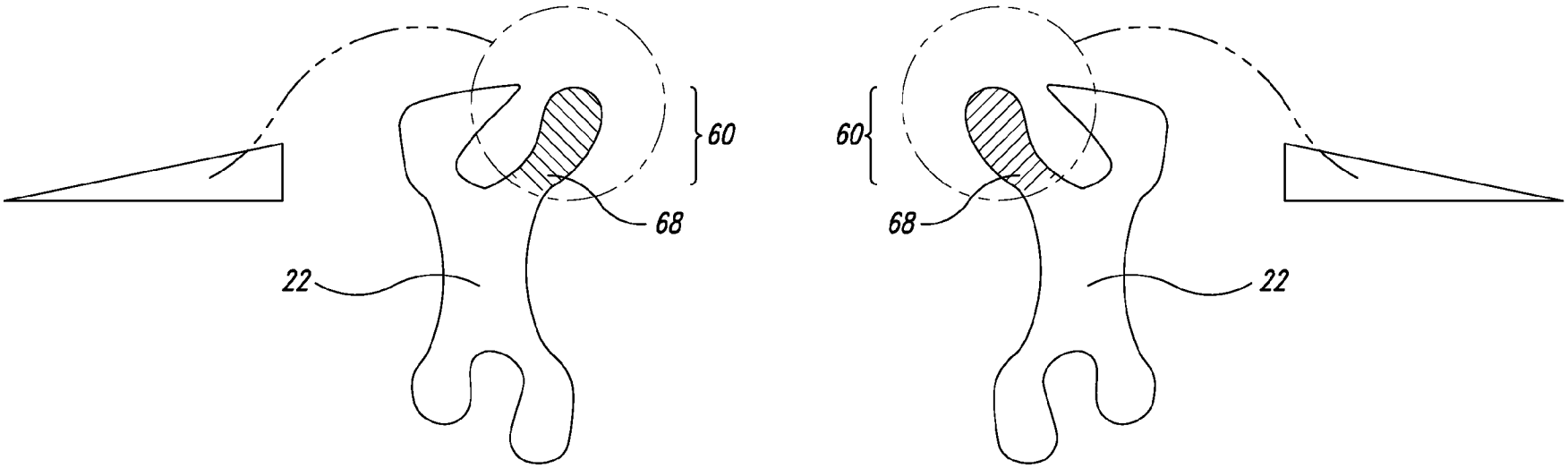
FIG. 17 is another diagram of a shank illustrating an area modified to provide a forefoot wedging.

For example, in some embodiments, a thickness of the front portion 60 of the shank 22 may be formed to generally increase with increasing distance away from the medial side 72 of the shank 22 such that the forefoot of a wearer is supported in an everted manner relative to the rear foot position when using the footwear. FIG. 16 illustrates an embodiment having a shank 22 of this type. Alternatively, as illustrated in FIG. 17, a thickness of the front portion 60 of the shank 22 may be formed to generally increase with increasing distance away from the lateral side 70 of the shank 22 such that the forefoot of a user is supported in an inverted manner relative to the rear foot position when using the footwear. In each of these embodiments, the orthotic shell 18 is shaped to interface with the wedge-shape portion of the shank 22 or intermediate supports therebetween and support the forefoot in a corresponding orientation.

Figure 20:
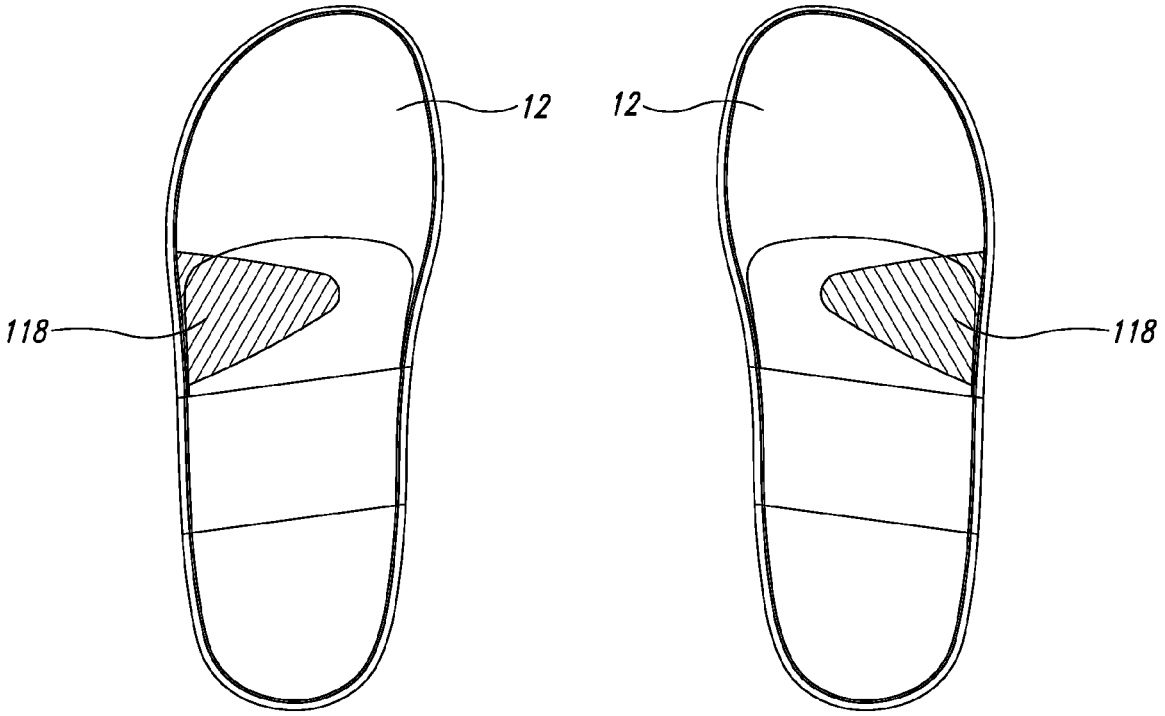
FIG. 20 is a diagram of a midsole illustrating a wedge-shaped portion thereof shaped to provide a forefoot wedging effect.
Figure 21:
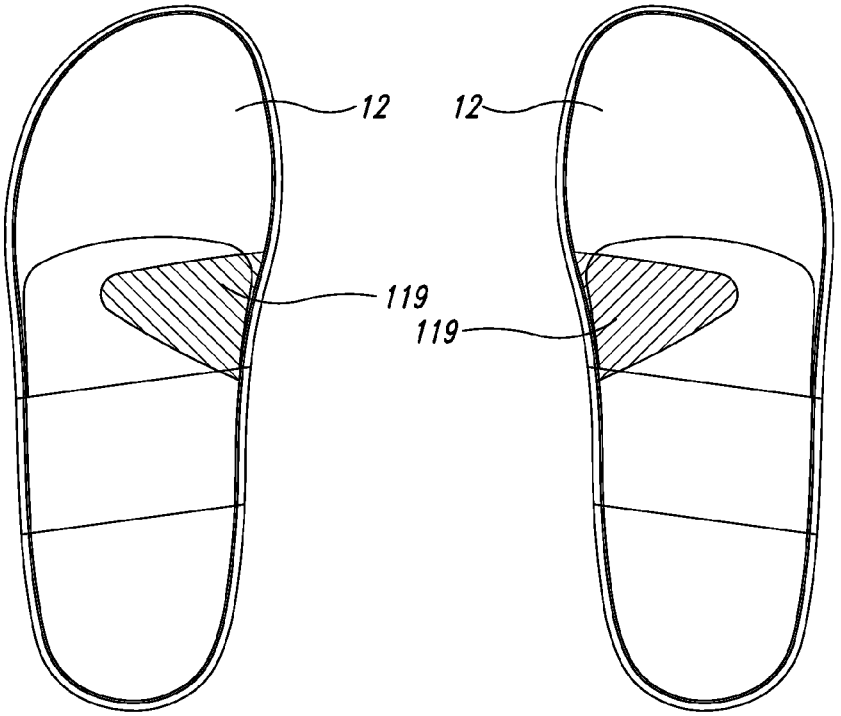
FIG. 21 is another diagram of a midsole illustrating a wedge-shaped portion thereof shaped to provide a forefoot wedging effect.

In other embodiments, as previously described, a single wedge-shaped support insert 120, 121 may be provided under the forefoot portion 52 of the orthotic shell 18 in lieu of the generally cylindrical plugs 20, to simulate a forefoot valgus or forefoot varus wedge. FIG. 18 illustrates an embodiment having such a wedge-shaped support insert 120 in the form of a forefoot valgus wedge and FIG. 19 illustrates an embodiment having such a wedge-shaped support insert 121 in the form of a forefoot varus wedge. In other embodiments, a portion 118, 119 of the midsole platform 12 itself may vary progressively in thickness from one side of the midsole platform 12 toward the other to simulate a forefoot valgus or forefoot varus wedge. FIG. 20 illustrates an embodiment having a midsole platform 12 with such a wedge-shaped portion 118 to simulate a forefoot valgus wedge. FIG. 21 illustrates an embodiment having a midsole platform 12 with such a wedge-shaped portion 119 to simulate a forefoot varus wedge. In each of these embodiments, the orthotic shell 18 is shaped to interface with the wedge-shaped support insert 120, 121 or the wedge-shaped portion 118, 119 of the midsole platform 12 and support the forefoot in a corresponding orientation.

Figure 22:
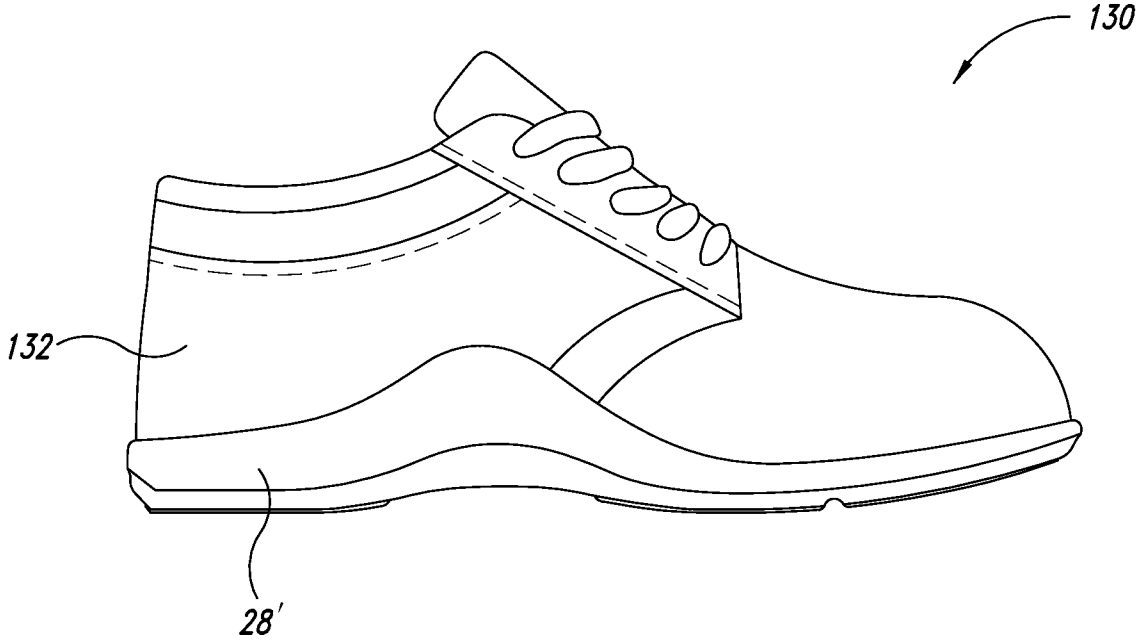
FIG. 22 is a side elevational view of footwear in the form of a casual shoe, according to one example embodiment.

Although embodiments have been shown and described herein as a sandal or components for a sandal, it is appreciated that aspects and features of the embodiments may be applied to a wide range of footwear, including without limitation, athletic shoes, casual shoes, dress shoes, work boots and recreational footwear such as snowboard boots and ski boots. For example, FIG. 22 illustrates footwear in the form of a casual shoe 130 having an upper 132 secured to a composite sole 28' which may constructed the same or similar to the composite sole 28 described above with reference to FIGS. 1 through 10.

Moreover, the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. Footwear comprising:

a midsole platform;

an insole;

an orthotic shell, the orthotic shell received between the midsole platform and the insole, and the orthotic shell having a heel portion to support a heel of a foot of a wearer and a forefoot portion to support a forefoot of the wearer at least in a region behind and near metatarsal heads of the foot, wherein the orthotic shell is shaped to partially cup the heel and support the forefoot such that distal metatarsal shafts of the foot are supported in a progressively elevated position from a first side of the foot toward an opposing side of the foot relative to a horizontal transverse plane when the footwear is worn; and a plurality of support plugs positioned within the midsole platform to help to stabilize the orthotic shell.

2. The footwear of claim 1 wherein the orthotic shell is shaped to support the distal metatarsal shafts in a progressively elevated position from a medial side of the forefoot toward a lateral side of the forefoot relative to the horizontal transverse plane to simulate a forefoot valgus wedge across a ball of the foot.

3. The footwear of claim 1 wherein the orthotic shell is shaped to support the distal metatarsal shafts in a progressively elevated position from a lateral side of the forefoot toward a medial side of the forefoot relative to the horizontal transverse plane to simulate a forefoot varus wedge across a ball of the foot.

4. The footwear of claim 1 wherein the plurality of support plugs are insertably and removably coupled to the midsole platform.

5. The footwear of claim 1 wherein the plurality of support plugs extend through the midsole platform from a lower surface thereof to an opposing upper surface.

6. The footwear of claim 1 wherein a shape of an upper surface of each of the support plugs substantially corresponds to a shape of the surface of the orthotic shell overlying each respective support plug.

7. The footwear of claim 1 wherein the support plugs have a generally circular cross-section.

8. The footwear of claim 1, further comprising:

a shank coupled to the midsole platform to increase flexural and torsional rigidity of the footwear with respect to a longitudinal length thereof.

9. The footwear of claim 1 wherein, when the footwear is worn by the wearer, a plane generally defined by the metatarsal heads of the foot is inclined with respect to a horizontal transverse plane such that a lateral side of the forefoot is supported in a more elevated position than a medial side of the forefoot.

10. The footwear of claim 1 wherein, when the footwear is worn by the wearer, a plane generally defined by the metatarsal heads of the foot is inclined with respect to a horizontal transverse plane such that a medial side of the forefoot is supported in a more elevated position than a lateral side of the forefoot.

11. The footwear of claim 1 wherein the orthotic shell is entirely enclosed between the midsole platform and the insole.

12. The footwear of claim 1 wherein the orthotic shell is removably received between the midsole platform and the insole.

13. The footwear of claim 1 wherein the orthotic shell is a material having a greater rigidity than a material of the midsole platform.

14. The footwear of claim 1 wherein a front end of the orthotic shell terminates in the region behind and near the metatarsal heads of the foot.

15. The footwear of claim 1 wherein the midsole platform is an outsole having a tread pattern on a lower surface thereof to enhance traction between the footwear and a ground surface.

16. The footwear of claim 1 further comprising:

an outsole underlying at least a portion of the midsole platform, the outsole having a tread pattern on a lower surface thereof to enhance traction between the footwear and a ground surface.

17. Footwear comprising:

a midsole platform;

an insole;

an orthotic shell, the orthotic shell received between the midsole platform and the insole, and the orthotic shell having a heel portion to support a heel of a foot of a wearer and a forefoot portion to support a forefoot of the wearer at least in a region behind and near metatarsal heads of the foot; and a plurality of support plugs positioned within the midsole platform to help to stabilize the orthotic shell, wherein the support plugs are integrally formed in the midsole platform.

18. Footwear comprising:

a midsole platform;

an insole;

an orthotic shell, the orthotic shell received between the midsole platform and the insole, and the orthotic shell having a heel portion to support a heel of a foot of a wearer and a forefoot portion to support a forefoot of the wearer at least in a region behind and near metatarsal heads of the foot;

a plurality of support plugs positioned within the midsole platform to help to stabilize the orthotic shell; and a shank coupled to the midsole platform to increase flexural and torsional rigidity of the footwear with respect to a longitudinal length thereof, wherein the shank includes a front portion underlying at least one of the support plugs and a rear portion underlying at least one other of the support plugs.

19. The footwear of claim 18 wherein the front portion of the shank includes two projections extending from a central portion of the shank, one of the projections generally located along a lateral side of the footwear and underlying a region of the midsole platform behind and near a contact area corresponding to the metatarsal head of a fifth metatarsal of the foot, and the other one of the projections generally located along a medial side of the footwear and underlying a region of the midsole platform behind and near a contact area corresponding to the metatarsal head of a first metatarsal of the foot.

20. The footwear of claim 19, wherein a part of the projection of the front portion of the shank located along the lateral side extends generally transversely such that the projection underlies at least a portion of a region of the midsole platform behind and near a contact area of at least the metatarsal heads corresponding to a second, third, fourth, and fifth metatarsal of the foot.

21. The footwear of claim 18 wherein the rear portion of the shank includes two projections extending from a central portion of the shank, one of the projections generally located along a lateral side of the footwear and underlying a first area transversely offset from a contact area corresponding to a calcaneous of the foot, and the other one of the projections generally located along a medial side of the footwear and underlying a second area transversely offset from the contact area corresponding to the calcaneous of the foot.

22. The footwear of claim 21 wherein the projection of the rear portion of the shank located along the medial side extends in a longitudinal direction further toward a back end of the footwear than the projection of the rear portion of the shank located along the lateral side.

23. The footwear of claim 8 wherein the front portion of the shank varies progressively in thickness from a first side thereof to an opposing side thereof to create a wedge underlying the forefoot portion of the orthotic shell.

24. The footwear of claim 23 wherein the front portion of the shank varies progressively in thickness with increasing distance away from a medial side of the shank toward a lateral side of the shank to simulate a forefoot valgus wedge.

25. The footwear of claim 23 wherein the front portion of the shank varies progressively in thickness with increasing distance away from a lateral side of the shank toward a medial side of the shank to simulate a forefoot varus wedge.

26. Footwear comprising:

a midsole platform;

an insole;

an orthotic shell, the orthotic shell received between the midsole platform and the insole, and the orthotic shell having a heel portion to support a heel of a foot of a wearer and a forefoot portion to support a forefoot of the wearer at least in a region behind and near metatarsal heads of the foot; and a plurality of support plugs positioned within the midsole platform to help to stabilize the orthotic shell, wherein the midsole platform includes a recess shaped to receive a corresponding shape of the orthotic shell.

27. Footwear comprising:

a midsole platform having a flex groove extending across a width thereof in a position and orientation corresponding generally to a reference line defined by metatarsal heads of a foot of a wearer;

an insole;

an orthotic shell, the orthotic shell received between the midsole platform and the insole, and the orthotic shell having a heel portion to support a heel of the foot and a forefoot portion to support a forefoot of the foot at least in a region behind and near the metatarsal heads of the foot; and a plurality of support plugs positioned within the midsole platform to help to stabilize the orthotic shell.

28. A foot support system comprising:

an orthotic shell, the orthotic shell having a heel portion to support a heel of a foot of a wearer, a midfoot portion to support an arch of the foot, and a forefoot portion to support a forefoot of the wearer at least in a region behind and near the metatarsal heads of the foot;

a shank positioned beneath the orthotic shell, the shank having a front portion, a rear portion and a central portion, the front portion of the shank underlying the forefoot portion of the orthotic shell, and the rear portion of the shank underlying the heel portion of the orthotic shell; and a plurality of support plugs positioned between the shank and the orthotic shell to support the orthotic shell in a determined orientation, wherein the front portion of the shank includes two projections extending from the central portion, one of the projections generally located along a lateral side of the shank, and the other one of the projections generally located along a medial side of the shank, and wherein the plurality of support plugs includes at least one support plug positioned between each of the projections of the front portion of the shank and the orthotic shell.

29. A foot support system comprising:

an orthotic shell, the orthotic shell having a heel portion to support a heel of a foot of a wearer, a midfoot portion to support an arch of the foot, and a forefoot portion to support a forefoot of the wearer at least in a region behind and near the metatarsal heads of the foot;

a shank positioned beneath the orthotic shell, the shank having a front portion, a rear portion and a central portion, the front portion of the shank underlying the forefoot portion of the orthotic shell, and the rear portion of the shank underlying the heel portion of the orthotic shell; and a plurality of support plugs positioned between the shank and the orthotic shell to support the orthotic shell in a determined orientation, wherein the rear portion of the shank includes two projections extending from the central portion, one of the projections generally located along a lateral side of the shank, and the other one of the projections generally located along a medial side of the shank, and wherein the plurality of support plugs includes at least one support plug positioned between each of the projections of the rear portion of the shank and the orthotic shell.

30. Footwear comprising:

a midsole platform;

an insole generally extending about an entire longitudinal length of the footwear;

an orthotic shell received between the midsole platform and the insole, the orthotic shell generally extending about three-quarters of the entire longitudinal length of the footwear and having a heel portion to support a heel of a foot of a wearer, a forefoot portion to support a forefoot of the wearer at least in a region behind and near metatarsal heads of the foot and a midfoot portion therebetween to support a midfoot of the foot; and at least one support plug within the midsole platform at a position to contact a portion of the orthotic shell, the support plug deformable to absorb force when the footwear is in use and having a rigidity greater than a rigidity of the midsole platform.

* * * * *